US005222327A

United States Patent [19]

Fellows et al.

[11] Patent Number: 5,222,327

[45] Date of Patent: Jun. 29, 1993

[54] SIDE MOUNT GARAGE DOOR OPERATOR

[76] Inventors: Donna M. Fellows, 4950 John Muir Rd., Martinez, Calif. 94553; William S. Dworzan, 368 S. Carolet La., Orange, Calif. 92669

[21] Appl. No.: 733,638

[22] Filed: Jul. 22, 1991

[51] Int. Cl.[5] ..... E05F 15/00

[52] U.S. Cl. ..... 49/139; 49/199; 49/362; 160/189; 200/47

[58] Field of Search ..... 49/139, 199, 200, 360, 49/362; 74/625; 160/189, 193; 200/47, 61.13, 61.14

[56] References Cited

U.S. PATENT DOCUMENTS

| | | | |
|---|---|---|---|
| 3,066,729 | 12/1962 | Gessell | 160/193 |
| 3,512,302 | 5/1970 | Sivin et al. | 49/139 |
| 3,591,981 | 7/1971 | Law | 49/139 |
| 3,825,809 | 7/1974 | Gatland et al. | 200/47 X |
| 4,018,005 | 4/1977 | Harris | 49/199 |
| 4,191,237 | 3/1980 | Voege | 160/189 X |
| 4,342,354 | 8/1982 | Leivenzon et al. | 49/139 X |
| 4,472,910 | 9/1984 | Iha | 49/139 |
| 4,605,108 | 8/1986 | Monot | 192/0.02 |

*Primary Examiner*—Peter M. Cuomo
*Assistant Examiner*—Jerry Redman
*Attorney, Agent, or Firm*—Schapp and Hatch

[57] ABSTRACT

A side mount garage door operator capable of being positioned on either the ceiling or end wall of a garage at either side of the garage door on a frame unit, the operator providing a clutch for disengaging the drive motor from the garage door in the absence of electric power and having a manual graspable handle operated by a solenoid when power is present and operable manually in the absence of power. Novel limit means having limits which is on the end of an axially movable bar which is moved by a follower riding in a spiral groove in the base of a disk such as a gear connected to the drive shaft.

15 Claims, 4 Drawing Sheets

SIDE MOUNT GARAGE DOOR OPERATOR

BACKGROUND OF THE INVENTION

1. Field of the Invention

This invention relates to apparatus for opening and closing garage doors of the side mount type, and more particularly to door opening and closing apparatus capable of being utilized with either roll-up or one-piece garage doors.

2. Description of the Prior Art

Present garage door openers are normally of either the center drive type wherein the motor and drive apparatus is mounted midway between the sides of the door on the ceiling of the garage, or the side mount type wherein the motor and driving apparatus are mounted at one side of the door and driving is accomplished through a sprocket chain assembly.

Such garage door openers sometimes become inoperative because of power failures, motor failures, track breakage and the like. In such circumstances it is still necessary that the garage door be opened and closed and that provision be made for doing so manually. In order to accomplish manual opening and closing, it becomes necessary to disconnect the drive motor from the door support mechanism. Otherwise, the mechanical characteristics of the motor and gears offer such resistance that manual opening and closing of the doors becomes extremely difficult, if not impossible. Typically, known side mount door operators are provided with a clutch mechanism between the drive motor and the drive shaft which can be disengaged by various mechanisms so as to disconnect the motor from the drive shaft and thus allow the door to be manually opened or closed. An example of such device is found in U.S. Pat. No. 4,472,910 issued to KiYoshi Iha on Sep. 25, 1984.

An example of a clutch mechanism is shown and described in applicants' co-pending patent application No. 07/556,614, which utilizes a sprag clutch. Other examples of such clutch mechanisms may be found in U.S. Pat. No. 3,066,729 issued to Glenn P. Gessell on Dec. 4, 1962; U.S. Pat. No. 3,512,302 issued May 19, 1970 to Bernard J. Sivin; and U.S. Pat. No. 4,605,108 issued Aug. 12, 1986 to Bernard Monot.

The above-listed patents are believed to be relevant to the present invention because they were adduced by a prior art search made by an independent searcher, and a copy of each of the above-listed patents is supplied to the Patent and Trademark Office herewith.

Prior art side mount garage door operators are capable of operating either a solid door or an articulated, segmented roll-up door, but not both.

SUMMARY OF THE INVENTION

The present invention provides a side mount garage door operator which can be used to drive and control raising and lowering of either a one-piece door or a roll-up garage door. These doors are usually provided with a conventional draw bar (chain drive type) for pulling the garage door open and for gushing it closed.

Alternatively, the garage door operator of the present invention may be connected to rotate the so-called "counterbalance shaft" often provided with sectional roll-up doors. The counterbalance shaft is mounted within one or more helically coiled springs which counterbalance the weight of the garage door by resisting rotation of the counterbalance shaft which is connected for joint movement with the garage door.

The garage door operator of the present invention is mounted within a frame or housing capable of being mounted at one side of the door on either the ceiling or the end wall of the garage. The garage door operator embodies an actuator having a reversible drive motor, a drive system operatively connected to the drive motor and having a drive shaft adapted for driving connection to a door opening and closing mechanism, means for selectively connecting and disconnecting the drive shaft the door opening and closing mechanism, and limit means responsive to the position of the garage door for reversing the direction of rotation of the drive motor.

The reversible drive motor is preferably electrically powered, and the drive motor is adapted for connection to a source of electrical energy, a switch being provided for initiating movement of the garage door from open position to closed position and from closed position to open position.

The means for selecting and disconnecting the drive shaft and door opening and closing mechanism includes clutch means interposed between the drive shaft and such mechanism, and having a selector member protruding from the clutch means formed for moving the clutch means between clutch engaged and clutch disengaged positions.

The limit means is provided with spaced apart limit switches connected in the power circuit, and a switching member is moveable between the limit switches and has an operative connection to the garage door for movement therewith. When the garage door reaches the desired maximum UP position, it actuates one of the limit switches which cuts off power to the electric drive motor. A control switch, usually mounted on the garage near the EXIT door initiates movement of the garage door from its UP position to its DOWN position and vice versa. Usually, portable remote control actuators are carried within the automobiles using the garage. These actuators operate the control switch, the actuator having a radio link with a receiver operatively connected to the control switch so that the garage door may be opened and closed from outside the garage by the driver of the automobile.

The operative connection between the limit switch switching member and the garage door includes a direction control operatively attached to the garage door for rotation in a first direction in accordance with opening movement of the garage door and in a reverse second direction in accordance with closing movement of the garage door. The direction control member is formed to provide a spiral track, preferably on the face of a flat disk, and a follower member riding in the spiral track to convert the rotary motion of the spiral track to lineal motion of the switching member.

A set of gears is interposed between the reversible drive motor and the drive shaft for increasing torque in the drive shaft.

The clutch means selector member preferably provides a graspable handle for manually urging the clutch means from clutch engaged position to clutch disengaged position in the absence of electric power. A solenoid is operatively connected to the selector member for urging the clutch means from the clutch engaged position to the clutch disengaged position, and back, when electric power is present.

The present invention provides a frame or housing mountable in the garage at a side of the garage door.

The same frame can be mounted either on the end wall of the garage or on the ceiling of the garage, depending upon the clearances in the garage structure. Guide means is adapted for mounting in the garage and is formed for guiding the garage door to its up and down terminal positions in the door opening. Limit means responsive to the position of the garage door for halting same at the terminal up and down positions is provided, along with control means for the drive motor formed for effecting halting of the garage door in the terminal positions and thereafter energizing the drive motor to move the garage door to the opposite one of its up and down terminal positions.

When the present unit is used to operate a chain-driven garage door, a sprocket is mounted on the output shaft and is adapted for driving engagement with the roller chain. When the present device is used as a side mount operator for a draw bar driven garage door, the output shaft carries a sprocket engagable with the drive chain of the roll-up door. Alternatively, the drive shaft is formed for coupling directly to an end of a counterbalance shaft connected to the garage door for twisting the counterbalance shaft to provide roll-up and roll-down movement of the garage door.

It is therefore a principal object of the present invention to provide a side mount garage door operator which is mountable on either the end wall or ceiling of the garage, and which is adapted to drive either a one-piece door or a roll-up sectional garage door.

Another object of the present invention is to provide a side mount garage door operator of the character described, and in which the apparatus is capable of use with either conventional draw bar door mechanisms, or counterbalance drive mechanisms.

A further object of the present invention is to provide a side mount garage door operator of the character described of electrically driven, compact high-torque design particularly suited for side mount operation of sectional roll-up doors.

A still further object of the present invention is to provide an apparatus of the character set forth which provides a novel, positive action tracking system which follows the position of the door under both driven and free-wheeling conditions.

Yet another object of the present invention is to provide a device of the character described in which the shift lever for the clutch assembly is operated by a solenoid to disengage the clutch when electrical power is not present at the operator unit.

Other objects and features of advantage will become apparent as the specification progresses and from the claims.

Figures 1, 6:
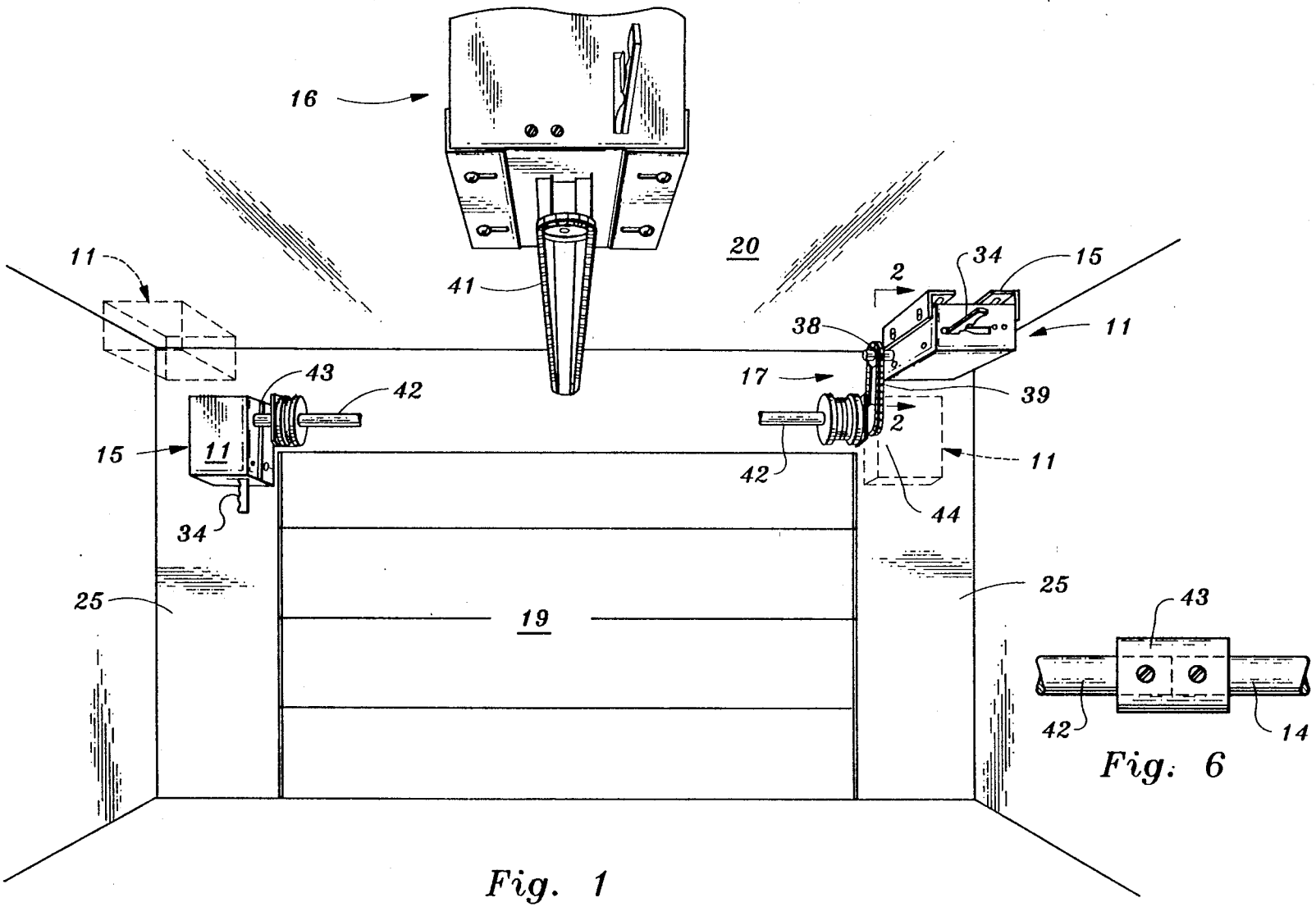
FIG. 1 is a perspective view of the interior of a garage looking toward the garage door opening and illustrating possible ceiling and end wall side mount positions.
FIG. 6 is an enlarged fragmentary view of a coupling joining a drive shaft to a counterbalance shaft.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings the side mount operator 11 of the present invention provides a reversible drive motor 12, a drive system 13 operatively connected to the drive motor 12 and having a drive shaft 14 adapted for driving connection to a door opening and closing mechanism 16, means 17 for selectively connecting and disconnecting the drive shaft 14 with the door opening and closing mechanism 16, and limit means 18 responsive to the position of a garage door 19 for reversing the direction of rotation of the reversible drive motor 12.

As a feature of the invention, the operator 11 is capable of being mounted within a frame or housing 15 capable of being mounted at one side of the garage door 19 on either the ceiling 20 or the end wall 25 of the garage. This flexibility of positioning makes it possible for the same unit to function in a variety of modes and configurations.

Figure 3A:
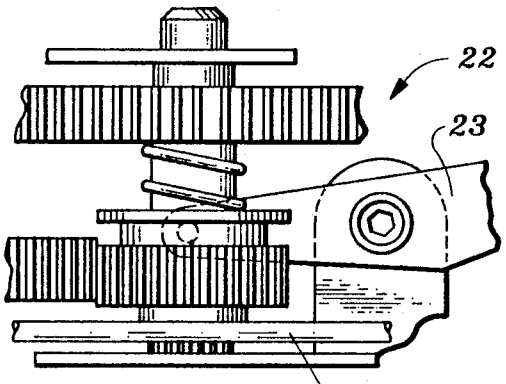
FIG. 3A is a fragmentary view of a clutch mechanism illustrated in FIG. 3 and showing the clutch in engaged position.

As here shown, the drive motor 12 is electrically powered, and the drive motor 12 is adapted for connection to a source 21 of electrical energy. The means 17 for selectively connecting and disconnecting the drive shaft 14 and the door opening and closing mechanism 16 has a clutch means 22 interposed between the drive shaft 14 and the mechanism 16, and providing a selector member 23 protruding from the clutch means 22 and formed for moving the clutch means between clutch engaged and clutch disengaged positions. The clutch engaged position is shown in FIG. 3A of the drawings, and the clutch disengaged position is shown in FIG. 3 of the drawings.

The limit means 18 is provided with spaced apart limit switches 24 and 26 and a switching member 27 formed for actuating the limit switches 24 and 26 and having an operative connection to the garage door 19 for movement therewith. Operative connection between the switching member 27 and the garage door 19 is here provided by a direction control member 28 operatively attached to the garage door 19 for rotation in a first direction in accordance with opening movement of the garage door 19 and in a reverse second direction in accordance with closing movement of the garage door 19. The direction control member 28 is formed to provide a spiral track 29, and the follower member 31 rides in the spiral track 29 and is connected for joint movement with the switching member 27.

As here shown, the spiral track 29 is in the form of a spiral groove cut into the face of a gear member 32 forming part of the operative connection of drive motor 12 with the garage door 19.

Figure 2:
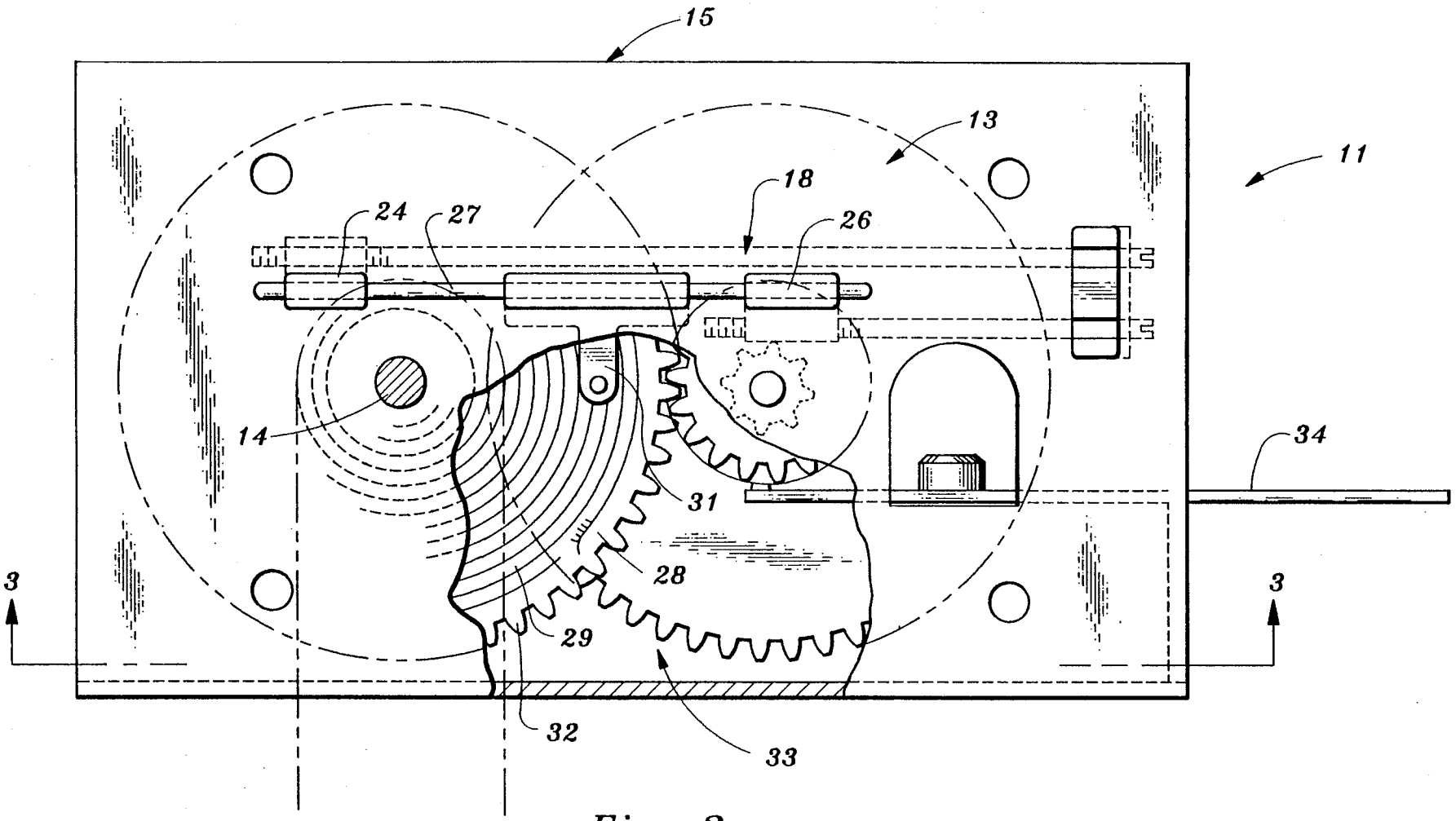
FIG. 2 is a front elevational view of a side mount operator constructed in accordance with the present invention, with portions broken away and other portions shown in dotted lines for clarity of illustration.
Figure 3:
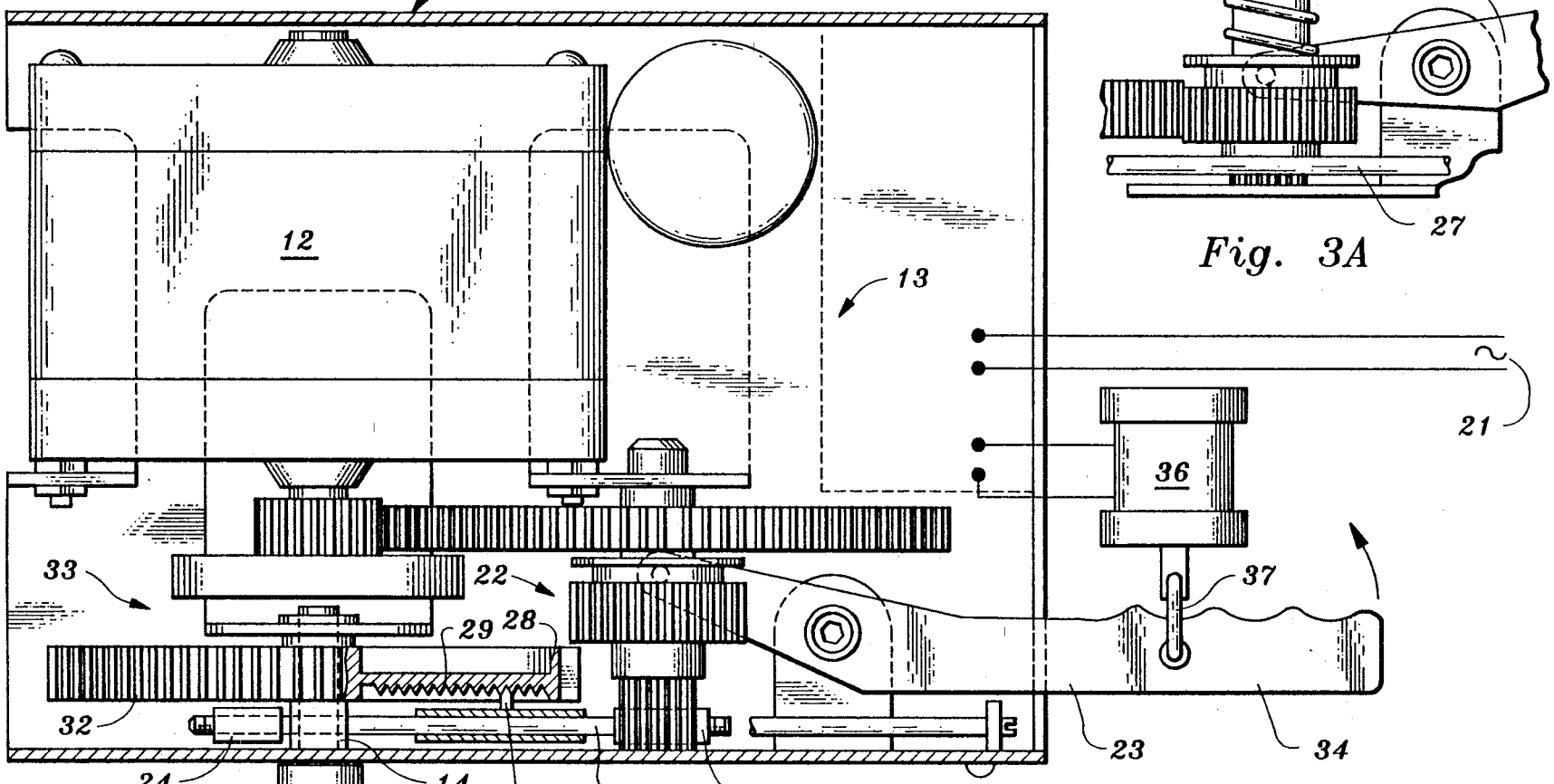
FIG. 3 is a vertical cross-sectional view taken substantially on the plane of Line 3—3 of FIG. 2.
Figure 4:
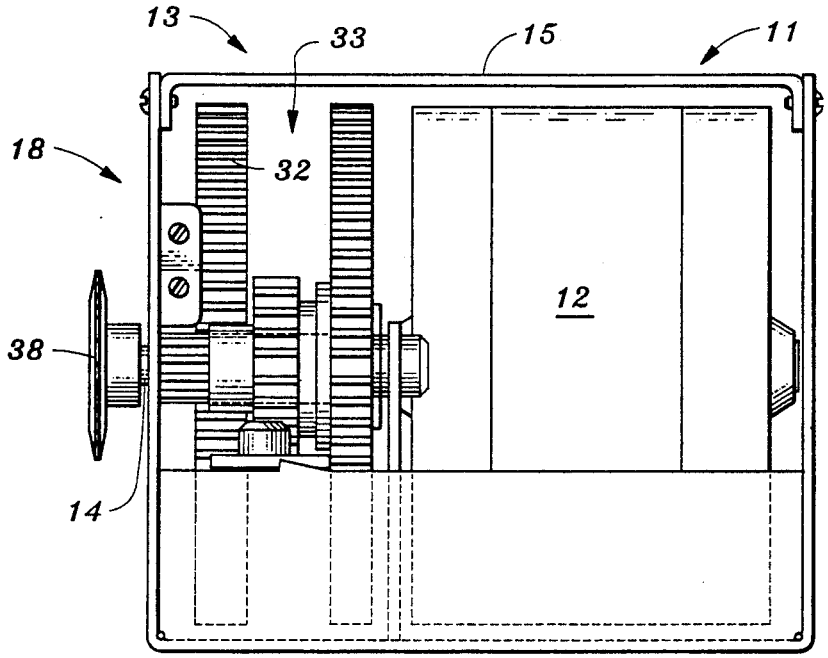
FIG. 4 is a plan view of the apparatus of FIGS. 2 and 3.
Figure 5:
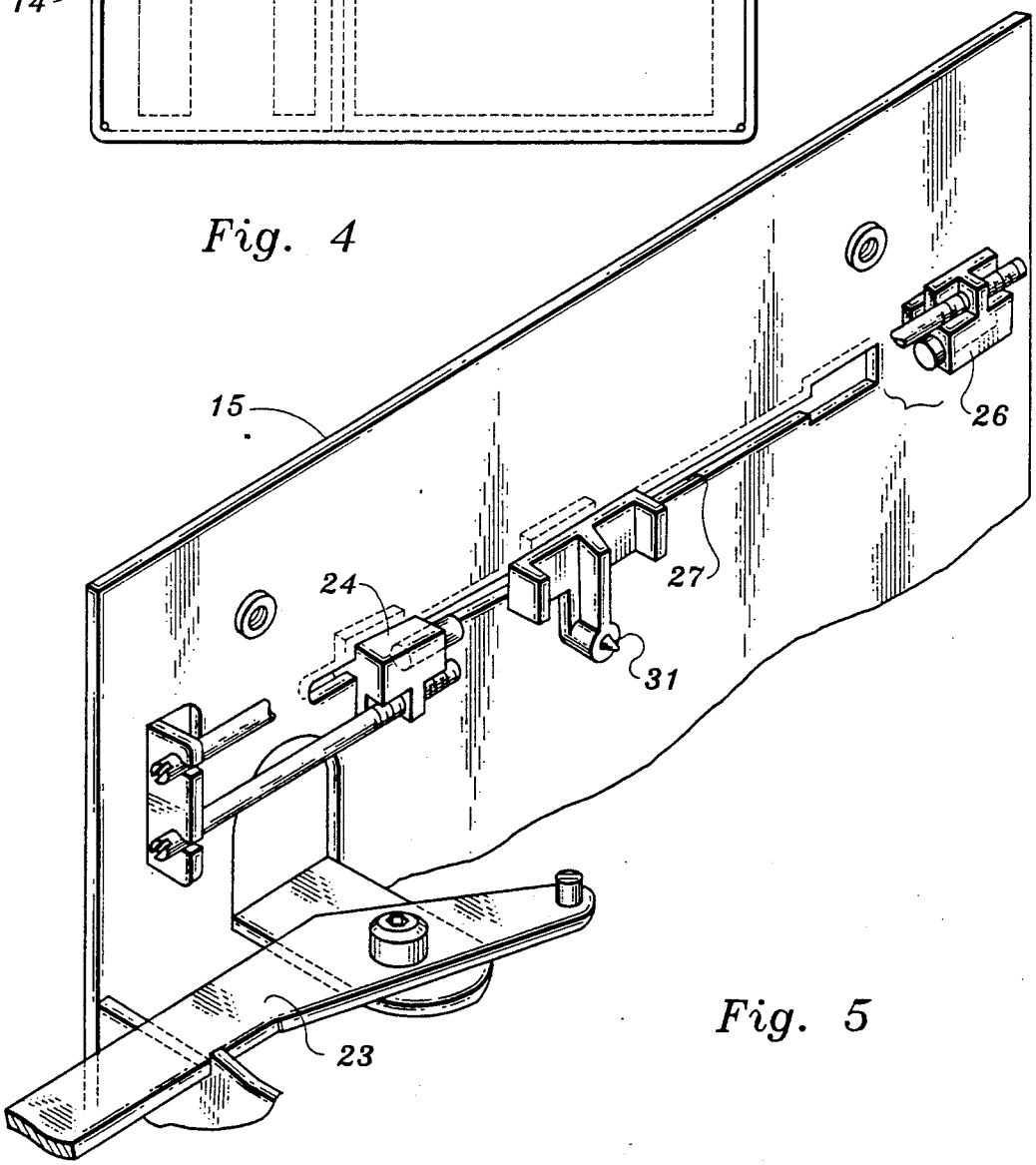
FIG. 5 is a perspective view of portions of the tracking apparatus and clutch operating apparatus of FIGS. 2 and 3.

A set of reduction gears 33 is interposed between the reversible drive motor 19 and the drive shaft 14 in the manner illustrated in FIGS. 2, 3 and 4 of the drawings, for multiplying the torque of the output shaft 14 and thus facilitating raising and lowering of the garage door 19.

In accordance with the present invention, the selector member 23 provides a graspable handle 34 formed for manual urging of the clutch means 22 from its clutch engaged position to its clutch disengaged position in the absence of electric power. A solenoid 36 is operatively connected to the handle 34 by a link 37 and is formed for urging the clutch means 22 from its clutch engaged position to its clutch disengaged position, and back, when electric power is present.

In the form of the invention illustrated in FIGS. 2 through 6 of the drawings, a sprocket 38 is mounted on the output shaft 14 and is adapted for driving engagement with the chain 39 of a chain-driven garage door. Alternatively, the output shaft 14 is adapted for driving connection to the draw bar of a draw bar-driven garage door.

In the form of the invention illustrated in FIG. 6 of the drawings, the drive shaft 14 is adapted for operative connection in side mount fashion to a sectional roll-up garage door 19 having a counterbalance shaft connected to the garage door so that rotation of the counterbalance shaft balances the weight of the door when the door is moving up or down. As a modified form of the invention, the drive shaft 14 is adapted for direct coupling to a counterbalance shaft 42 as by a connector coupling 43. Alternatively, the operative connection of the drive shaft 14 to the counterbalance shaft 42 is accomplished by means of a chain-and-sprocket assembly 44, the chain of which is entrained on the sprocket 38.

From the foregoing it will be apparent that the side mount garage door operator of the present invention provides unparalleled flexibility of mounting positions for an operator capable of use with a variety of existing and conventional garage door mountings.

What is claimed is:

1. An actuator for operating a garage door, comprising:

a reversible drive motor;

a drive system operatively connected to said drive motor and having a drive shaft adapted for driving connection to a door opening and closing mechanism;

means for selectively connecting and disconnecting said drive shaft with said door opening and closing mechanism;

limit means responsive to the position of said garage door for reversing said reversible drive motor, said limit means being comprised of spaced apart limit switches and switch actuating means for actuating said limit switches and having an operative connection to said garage door for movement therewith; and a direction control member operatively attached to said garage door for rotation in a first direction in accordance with opening movement of said garage door and in a reverse second direction in accordance with closing movement of said garage door, said direction control member being formed to provide a planar spiral track, and a follower member riding in said planar spiral track and connected for joint movement with said switch actuating means for operating both of said limit switches.

2. An actuator for operating a garage door as claimed in claim 1 wherein a set of reduction gears is interposed between said reversible drive motor and said drive shaft.

3. An actuator for operating a garage door as claimed in claim 1 wherein said means for selectively connecting and disconnecting said drive shaft and said door opening and closing mechanism comprises clutch means interposed between said drive shaft and said mechanism and a selector member protruding from said clutch means and formed for moving said clutch means between clutch engaged and clutch disengaged positions.

4. An actuator for operating a garage door as claimed in claim 3 wherein said selector member provides a graspable handle formed for manually urging of said clutch means from said clutch engaged position to said clutch disengaged position in the absence of electrical power.

5. An actuator for operating a garage door as claimed in claim 4 wherein a solenoid is operably connected to said selector member for urging said clutch means from said clutch engaged position to said clutch disengaged position and back when electrical power is present.

6. A side mount actuator for automatically operating a garage door to selectively cover a door opening in a garage end wall, comprising:

frame means mountable in said garage at a side of said garage door;

a power driven operator unit having a reversible drive motor mounted on said frame means and a drive shaft and having an operative connection to said garage door;

a drive system in said operator unit supported by said frame and interposed in said operative connection between said garage door and said drive motor;

limit means responsive to the position of said garage door for halting the same at first and second terminal positions;

control means for said drive motor formed for effecting said halting of said garage door in said terminal positions and thereafter moving said garage door to the opposite one of said terminal positions; and actuating means for actuating said limit means, said actuating means comprising a direction control member operatively attached to said garage door for rotation in a first direction in accordance with the opening movement of said garage door and a reverse second direction in accordance with the closing movement of said garage door, said direction control member being formed to provide a planar spiral track, and a follower member riding in said planar spiral track for driving on actuator to alternatively actuate both of said limit means.

7. A side mount actuator as claimed in claim 6 wherein a set of gears is interposed between said reversible drive motor and said drive shaft.

8. A side mount actuator as claimed in claim 6 further comprising a selector member which provides a graspable handle for manually urging said clutch means from said clutch engaged position to said clutch disengaged position in the absence of electrical power.

9. A side mount actuator as claimed in claim 8 wherein a solenoid is operably connected to said selector member for urging said clutch means from said clutch engaged position to said clutch disengaged position and back when electrical power is present.

10. A side mount actuator as claimed in claim 6 wherein said frame means is mountable on the end wall of said garage and said operator unit has an output shaft connectible to said garage door for moving the said garage door to said up and down terminal positions.

11. A side mount actuator as claimed in claim 8 wherein a sprocket is mounted on the output shaft and is adapted for driving engagement with the chain of a chain-driven garage door.

12. A side mount actuator as claimed in claim 10 wherein said output shaft is adapted for driving connection to the draw bar of a draw bar driven garage door.

13. A side mount actuator as claimed in claim 10 wherein said drive shaft is adapted for operative connection in side mount fashion to a sectional roll-up garage door.

14. A side mount actuator as claimed in claim 13 wherein a counter balance shaft is connected to the garage door and said drive shaft is formed for coupling to an end of said counter balance shaft.

15. A aide mount actuator as claimed in claim 13 wherein said operative connection of said operator unit comprises a chain and sprocket assembly.

* * * * *